US005615273A

United States Patent [19]

Lucey et al.

[11] Patent Number: 5,615,273

[45] **Date of Patent: *Mar. 25, 1997**

[54] MICROPHONE ASSEMBLY IN A MICROPHONE BOOM OF A HEADSET

[75] Inventors: Robert E. Lucey, Sudbury; James T. MacDonald, Pepperell, both of Mass.

[73] Assignee: UNEX Corporation, Chelmsford, Mass.

[ * ] Notice: The term of this patent shall not extend beyond the expiration date of Pat. No. 5,410,608.

[21] Appl. No.: 342,428

[22] Filed: Nov. 18, 1994

Related U.S. Application Data

[63] Continuation of Ser. No. 952,956, Sep. 29, 1992, Pat. No. 5,410,608.

[51] Int. Cl.[6] ..... H04R 25/00

[52] U.S. Cl. ..... 381/169; 381/168; 381/155

[58] Field of Search ..... 381/169, 168, 381/88, 155, 112, 113, 114, 115, 173, 122, 177, 91, 92, 183, 187, 188, 205, 25; 181/129, 158; 379/430, 449

[56] References Cited

U.S. PATENT DOCUMENTS

| | | | |
|---|---|---|---|
| 3,527,902 | 9/1970 | Van Liempd | 179/121 |
| 3,637,938 | 1/1972 | Kuhlow et al. | 381/188 |
| 3,989,905 | 11/1976 | Anderson et al. | 179/121 R |
| 4,006,371 | 2/1977 | Quirke | 310/8.2 |
| 4,163,917 | 8/1979 | Levine | 310/327 |
| 4,189,627 | 2/1980 | Flanagan | 179/180 |
| 4,232,205 | 11/1980 | Ribeyre | 179/146 R |
| 4,251,686 | 2/1981 | Sokolich | 179/1 N |
| 4,277,179 | 7/1981 | Bruce | 356/433 |
| 4,379,211 | 4/1983 | Joscelyn et al. . | |
| 4,443,667 | 4/1984 | Hunt | 179/115 R |
| 4,450,930 | 5/1984 | Killion | 181/158 |
| 4,494,841 | 1/1985 | Marcus | 354/21 |
| 4,511,768 | 4/1985 | Patel | 179/146 R |
| 4,646,873 | 3/1987 | Bryson | 181/160 |
| 4,811,402 | 3/1989 | Ward | 381/68.6 |
| 4,815,560 | 3/1989 | Madaffari | 181/158 |
| 4,817,164 | 3/1989 | Bertignoll et al. | 381/189 |
| 4,821,320 | 4/1989 | Andert et al. | 379/437 |
| 4,837,833 | 6/1989 | Madaffari | 381/69 |
| 4,843,628 | 6/1989 | Hofer | 381/200 |
| 4,870,688 | 9/1989 | Voroba et al. | 381/60 |
| 4,937,877 | 6/1990 | Pocock et al. | 381/158 |
| 5,136,656 | 8/1992 | Frederiksen et al. | 381/56 |

*Primary Examiner*—Sinh Tran
*Attorney, Agent, or Firm*—Weingarten, Schurgin, Gagnebin & Hayes LLP

[57] ABSTRACT

A microphone holder includes a housing comprising a base portion having a first aperture therein and sidewall portions disposed on the base to provide the housing with a microphone receiving cavity region. A cover, having a second aperture therein, is disposed over the cavity region of the housing and a baffle is disposed a predetermined distance over a first surface of the cover in the region of the second aperture.

19 Claims, 4 Drawing Sheets

MICROPHONE ASSEMBLY IN A MICROPHONE BOOM OF A HEADSET

This Application is a continuation of application Ser. No. 07/952,956 filed Sep. 29, 1992, now U.S. Pat. No. 5,410, 608.

BACKGROUND OF THE INVENTION

This invention relates to head-set assemblies and more particularly to microphone assemblies disposed therein.

As is known in the art a head-set assembly often includes a receiver coupled to a user's ear and a microphone assembly disposed near the user's mouth. The microphone is generally provided having a body made of metal disposed in a molded, plastic microphone housing which is secured to a first end of a boom. A second end of the boom is connected to the receiver. Thus, the boom physically connects and supports the microphone and the receiver. A coaxial cable, such as a twisted pair or shielded conductors, electrically connects the microphone and the receiver. To provide the microphone assembly with an acceptable acoustic response, an acoustic foam is disposed on an inside surface of the microphone housing and the microphone is disposed in the housing and the acoustic foam is placed at least on one side thereof.

As is also known in the art, electrostatic charges typically in the range of 5 kilovolts to 20 kilovolts or more can easily accumulate on a person working in a modern office environment particularly where extensive use is made of synthetic carpeting. Thus, one problem with the head-set assembly is that such electrostatic charges which accumulate on the user of the head-set discharge from the user to the metal body of the microphone or to exposed conductors of the twisted pair wires connected to the microphone which is at a near ground potential.

The discharge thus provides an electric shock to the user and may also result in temporary or permanent damage to the microphone, the receiver or other electrical components within the head-set. Conventional microphone assemblies have not adequately avoided such electric discharge potential while preserving audio fidelity.

SUMMARY OF THE INVENTION

In accordance with the present invention a microphone holder includes a housing having a base portion with a first aperture therein and sidewall portions disposed on the base to provide the housing having a cavity region. The microphone holder further includes a cover having an aperture therein disposed over the cavity region of the housing and a baffle having a first surface disposed a predetermined distance over a first surface of the cover in the aperture region of the cover. With this particular arrangement a microphone holder having a desirable frequency response and directionality while reducing electrostatic discharge between a microphone and a user, for example, is provided. A microphone may be disposed in the cavity of the housing and the housing may be disposed on a first end of a boom with a second end of the boom being coupled to an ear mounted receiver to thus provide a head-set assembly. The base portion of the housing having the first aperture and a first cavity region therein provides an impedance matching structure for the microphone assembly such that the microphone may provide a relatively flat frequency response in the acoustic signal frequency range. Furthermore, an acoustic pad for dampening high frequency signals may be disposed over the first surface of the microphone to further improve the impedance characteristic of the housing cavity over a predetermined range of frequencies. The cover, having an aperture therein, in combination with the baffle disposed a predetermined distance above the aperture increases the breakdown voltage between exposed conductors attached to the microphone, for example, and the opening in the cover. Thus this arrangement reduces the likelihood of electrostatic charges accumulated on the user discharging to the microphone or the exposed conductor attached thereto and thereby lessens the likelihood of damage to electrical components in the headset and provides a more reliable headset and a more comfortable environment in which the user may use the headset. Furthermore, the housing having the cover disposed thereover provides an enclosure for the microphone having a desirable impedance characteristic over a predetermined range of frequencies. The baffle is disposed over the cover such that the impedance characteristic of the enclosure remains substantially unchanged.

BRIEF DESCRIPTION OF THE DRAWINGS

The foregoing features of this invention as well as the invention itself may be more fully understood from the following Brief Description of the Drawings in which.

DESCRIPTION OF THE PREFERRED EMBODIMENTS

Figure 1:
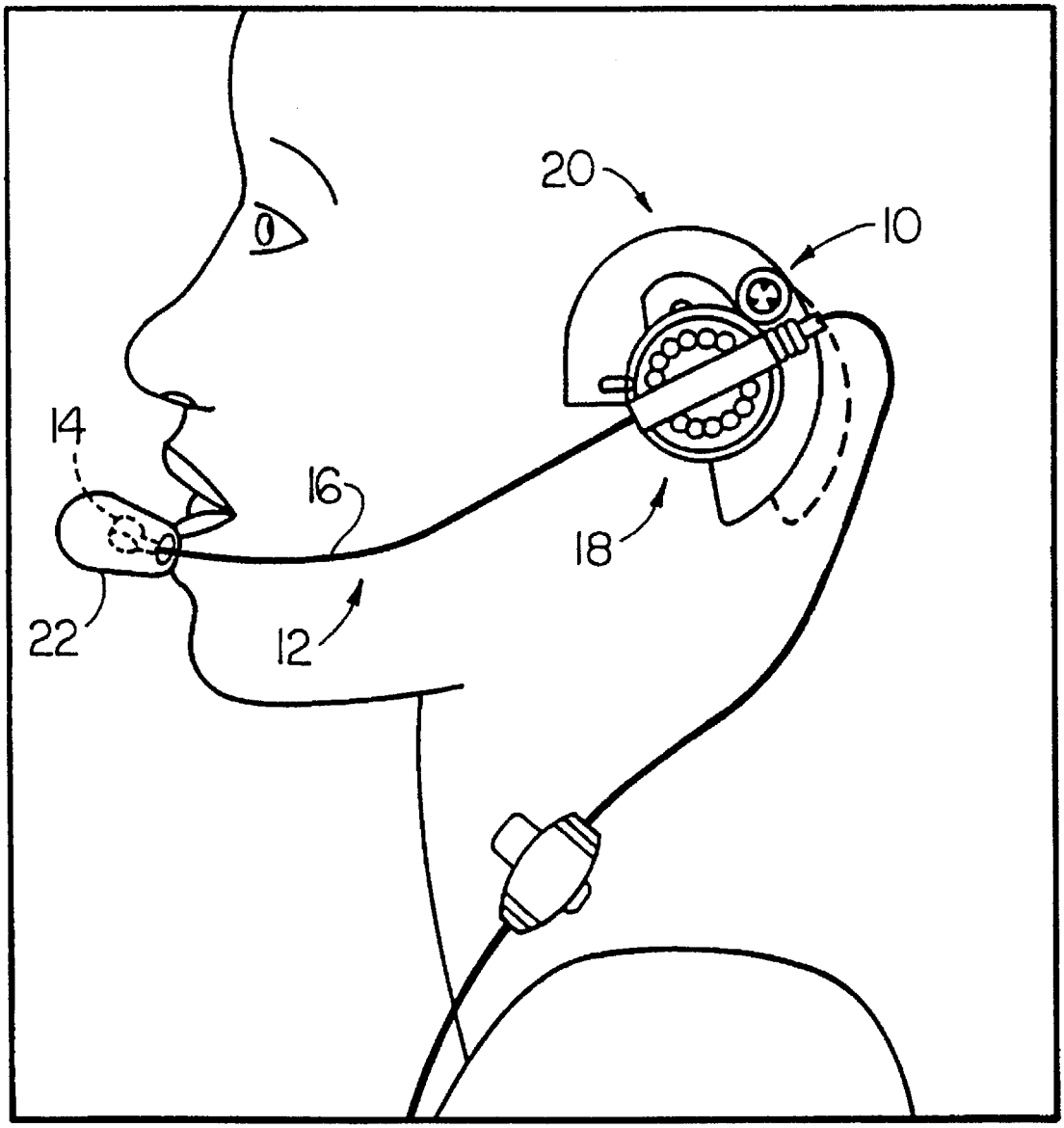
FIG. 1 is a side view of a head-set assembly disposed on a user.

Referring now to FIG. 1 a head-set assembly 10 is shown to include a boom 12 having a first end coupled to a microphone assembly 14 and a second end coupled to a receiver 18. A shielded two conductor transmission line 16 disposed along the boom 12 provides an electrical connection between the microphone assembly 14 and the receiver 18. Means 20 for attaching the head-set 10 to an ear of a user is shown disposed about the receiver 18 and attached to the second end of the boom 12. A removable open cell foam cover 22 disposed about the microphone assembly 14 reduces the amount of sound transmitted to the microphone due to undesirable extraneous noises such as so-called breath pops and also protects the microphone assembly 14 from dust and other undesirable particles which would otherwise accumulate on the microphone assembly 14.

Figure 2:
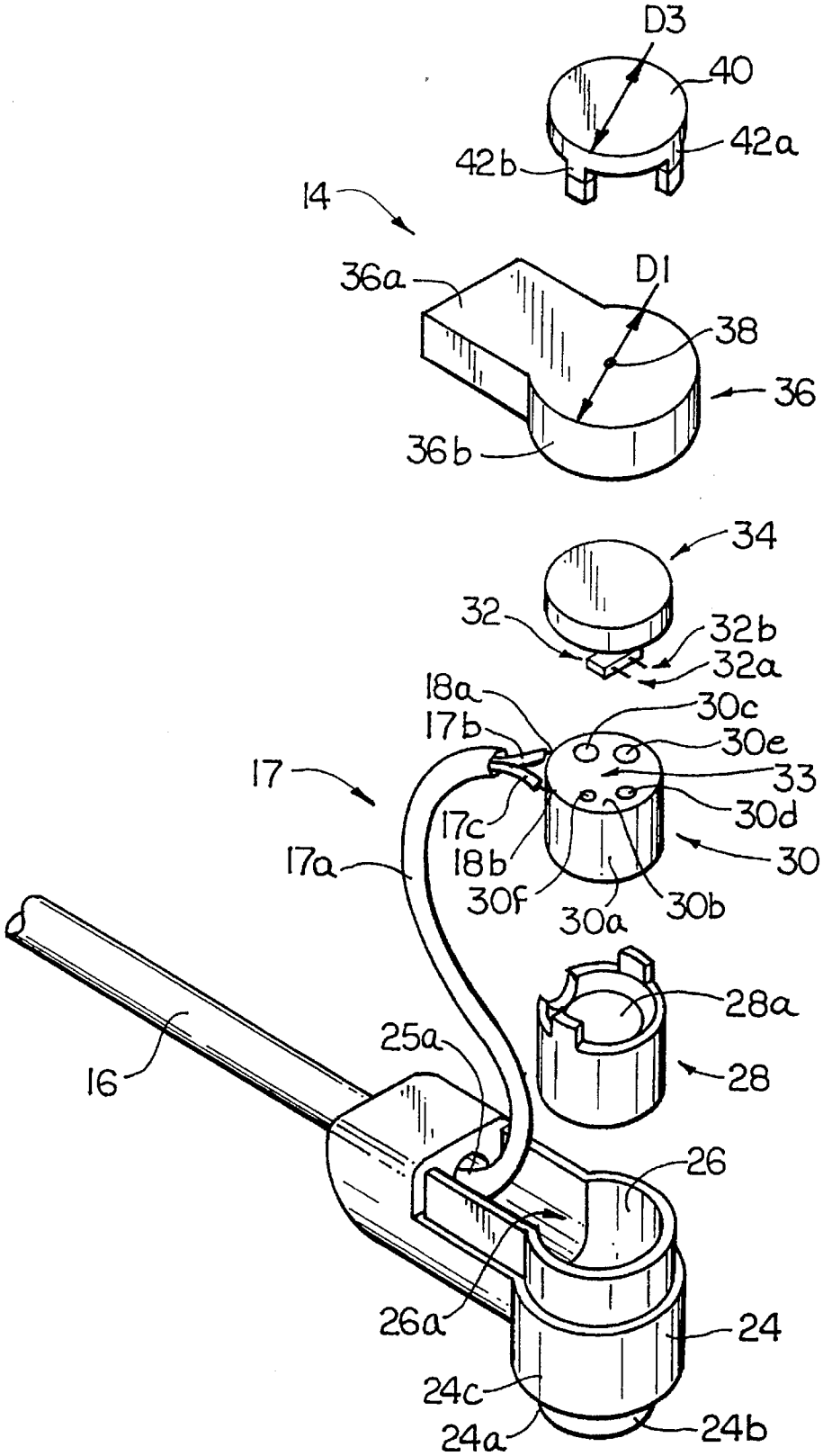
FIG. 2 is an exploded view of a microphone assembly of the type used in the head-set of FIG. 1.

Referring now to FIG. 2, the microphone assembly 14 of FIG. 1 is shown to include a microphone housing 24 here provided from molded plastic. The microphone housing 24 includes a base region **24*a* having a recess 24*b* disposed therein and sidewall regions 24*c* integrally formed and coupled to said base 24*a* to provide the microphone housing 24 having a cavity region 26 and a first open end 26*a***.

A microphone boot 28 here provided from an "acoustically dead" rubber material such as santoprene thermoplastic rubber is disposed in the cavity 26. The microphone boot 28 is provided having a cavity region **28*a* shaped to conformally accept a microphone 30 disposed in the cavity region 28*a* of the microphone boot 28. The microphone boot 28 mates with a V shaped groove in the microphone housing 24** to seal the boot 28 to the cavity and thus the microphone is sealed to the front cavity.

The microphone 30 includes a metal housing 30*a*, a metal cover 30*b*, conductor contact regions 30*c* and 30*d* and rear microphone ports 30*e*, 30*f*. The rear microphone ports 30*e*, 30*f* act as delay lines to cancel out of phase signals which enter the opposite side of the microphone 30, and thus provide the microphone as a directional microphone. The shielded two conductor transmission line 16 is fed into a first opening 25*a* of the microphone housing 24 as shown.

Figure 3:
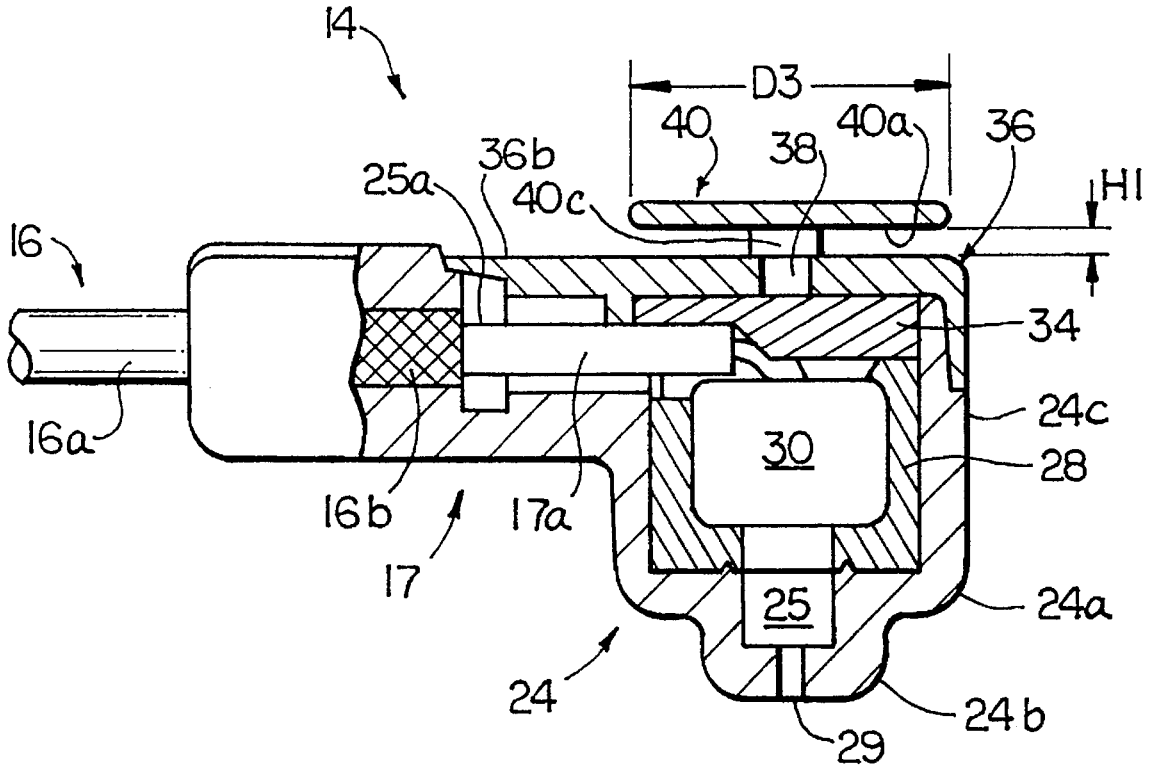
FIG. 3 is a cross-sectional view of the assembled microphone assembly of the type shown in FIGS. 1 and 2.

Referring momentarily to FIG. 3, the shielded two conductor transmission line 16 is more clearly shown disposed in the microphone housing 24. A portion of an outer jacket 16*a* is stripped away to reveal a first portion of a conductive shield 16*b*. A first portion of the conductive shield is removed to expose a shielded insulated wire 17 having an outer dielectric jacket 17*a*.

Referring again to FIG. 2 a portion of the outer jacket 17*a* is stripped back to expose first and second shielded insulated conductors 17*b* and 17*c*. Portions of the shields are stripped back to expose portions of the conductors 18*a* and 18*b*. The exposed conductors 18*a* and 18*b* are electrically coupled to the microphone 30.

A diode 32 having first and second electrodes 32*a*, 32*b* is disposed on a PC board 33 disposed on a first surface of and electrically coupled to the microphone 30. The printed circuit board provided has two solder pads (contact regions 30*c* and 30*d*) one of which is connected to the microphone case. The diode 32 which is here provided as a Zener diode is coupled across the solder pads of the printed circuit board.

A microphone damping pad 34 here provided from polyester urethane or any other similar material selected to improve the acoustic properties of the microphone housing 30*a* and to match the acoustic properties of the microphone housing 24 to the microphone 30 is disposed over the diode 32.

The damping pad 34 is here provided from a Loe perm foam having a high number of unbroken fine cell "windows" or membranes to provide the foam having a low air and vapor permeability.

A cover 36, here provided from molded plastic, includes a top wall 36*a* having an aperture 38 centrally disposed therein and sidewalls 36*b*. Here, sidewalls 36*b* are integrally formed with the top wall 36*a*. The cover 36 is provided having a shape corresponding to the shape of the microphone housing 24 and is here provided having a substantially circular portion with a diameter D1 typically of about 0.406 inch (in.) selected to provide a so-called "snap fit" over the open end 26*a* of the microphone housing 24 to thus provide an enclosed microphone assembly 14. The aperture 38 is here provided having a diameter typically of about 0.054 in.

Support members 42*a*, 42*b* and 42*c* (FIG. 2) are disposed on a first surface 36*a* of the cover 36 about the aperture 38 and space a baffle 40, here provided having a disk shape with a diameter D3 typically of about 0.350 in., a predetermined distance above the first surface 36*a* of the cover 36. Here, for convenience, support members are shown provided as an integral portion of the baffle 40. Those of skill in the art, however, will recognize that cover 36, baffle 40 and support members 42*a*–42*c* may be integrally formed and provided as one piece via injection molding techniques, for example, or alternatively each piece may be provided separately and assembled using conventional techniques.

Referring now to FIG. 3, where like elements of the microphone assembly 14 of FIG. 2 are given like designations, the cover 36 is provided having a thickness typically of about 0.045 in. with the aperture 38 having a diameter typically of about 0.054 in. The baffle 40 having a thickness typically of about 0.025 in. is shown disposed over the cover 36 with a first surface of the baffle 40*a* spaced a distance H1, here typically of about 0.035 in. over the first surface 36*b* of the cover 36. Thus, the baffle 40 provides a barrier between any electrostatic charges which may tend to discharge from a user (FIG. 1) through the aperture 38 and to the exposed conductors 18*a*, 18*b* or to the microphone housing 30*a*.

Moreover the baffle 40 increases the physical path length such that electrostatic charges must travel to discharge on the exposed conductors 18*a*, 18*b*, the microphone housing 30*a* or the printed circuit board cover 33. That is, electrostatic charges must travel on a path around the baffle 40 to enter the aperture 38 and discharge on the exposed conductors 18*a*, 18*b*, the microphone housing 30*a* or the metal cover 30*b*. Thus the baffle 40 increases the breakdown voltage required to result in discharge of the charges between the user and the exposed conductors 18*a*, 18*b* or the microphone housing 30*a* or the printed circuit board 33.

The recess region 24*b* of the microphone housing 24 includes a circular cavity region 25 having a diameter typically of about 0.104 in. and a height typically of about 0.082 inch. A circular bore 29 having a diameter typical of about 0.021 in. is disposed through the wall of the recess 24*b* in a region having a thickness typically of about 0.054 in. to provide a passage between the cavity region 25 and the region outside the microphone housing 24.

Audio signals, from the user (FIG. 1) for example, pass through the bore 29 and the cavity 25 and are incident on the microphone 30. The dimensions of the cavity 25 and the bore 29 are selected to provide the microphone housing 24 having an optimum acoustic response with the microphone 30 disposed therein.

The diameter D3 of the baffle 40 and distance H1 of the baffle 40 above the first surface 36*b* of the cover 36 are selected to provide both protection from electrostatic discharge and to preserve the matched impedance characteristic provided by the cooperation of the cavity 26, the cavity recess 25, the bore 29, the microphone boot 28, the microphone damping pad 34 and the aperture 38.

The distance H1 and the diameter D1 may be determined empirically in the following manner. The microphone 30 is disposed in the microphone boot 28 and in the cavity 26 of the housing 24 and coupled to the coaxial cable 16 as described hereinabove in conjunction with FIG. 2. The microphone damping pad 34 is disposed over the microphone 30 to "load" the cavity and thus prevent extraneous signals from resonating in the cavity. The cover 36, having the aperture 38 therein is disposed over the opening 26*a* of the microphone housing 24. The baffle 40 is disposed a predetermined distance, but preferably not less than 0.045 inch, over the aperture 38. The acoustic and electrostatic discharge properties of the assembly are then tested. The distance H1 of the baffle 40 above the cover 36 and the diameter D3 of the baffle 40 affect the tuning of the rear cavity 26. Thus, either the distance H1 or the diameter D3 of the baffle 40 or both the distance H1 and the diameter D3 may be adjusted to optimize the performance of the microphone assembly 14.

The ratio of the diameter D1 of the cover 36 to the diameter of the aperture 38 is typically in the range of eight to fourteen.

The cross sectional area of the circular slot which couples the aperture is preferably much greater than the area aperture 38 to provide low inductance to minimize the tuning. Here the area of the aperture 38 is 0.0023 $in^2$ while the area of the cavity above 38 is typically of about 0.0076 $in^2$. The object of the cavity 26 is to provide the necessary distance for discharge prevention and to minimize the inductance. That is, the holes act acoustically as the equivalent as an electrical inductor.

Those of skill in the art, however will recognize the precise size and shape of the aperture 38 and cover 36 as well as the size and shape of the baffle 40 and the distance H1 at which the baffle 40 is disposed above the cover 36 may be selected to provide optimum electrostatic discharge protection and optimum acoustic performance based on a variety of factors including but not limited to the size and shape of the cavity 26, the size and shape of the opening 26*a*, the dimensions of the cavity recess 25, the dimensions of the bore 29, and also the materials, shape and thicknesses selected to provide the microphone damping pad 34 and the microphone boot 28.

Alternatively, the size of certain features of the microphone assembly 14 may be selected using analytical techniques as will be described in conjunction with FIG. 4 and optimized using the above described empirical techniques.

Figure 4:
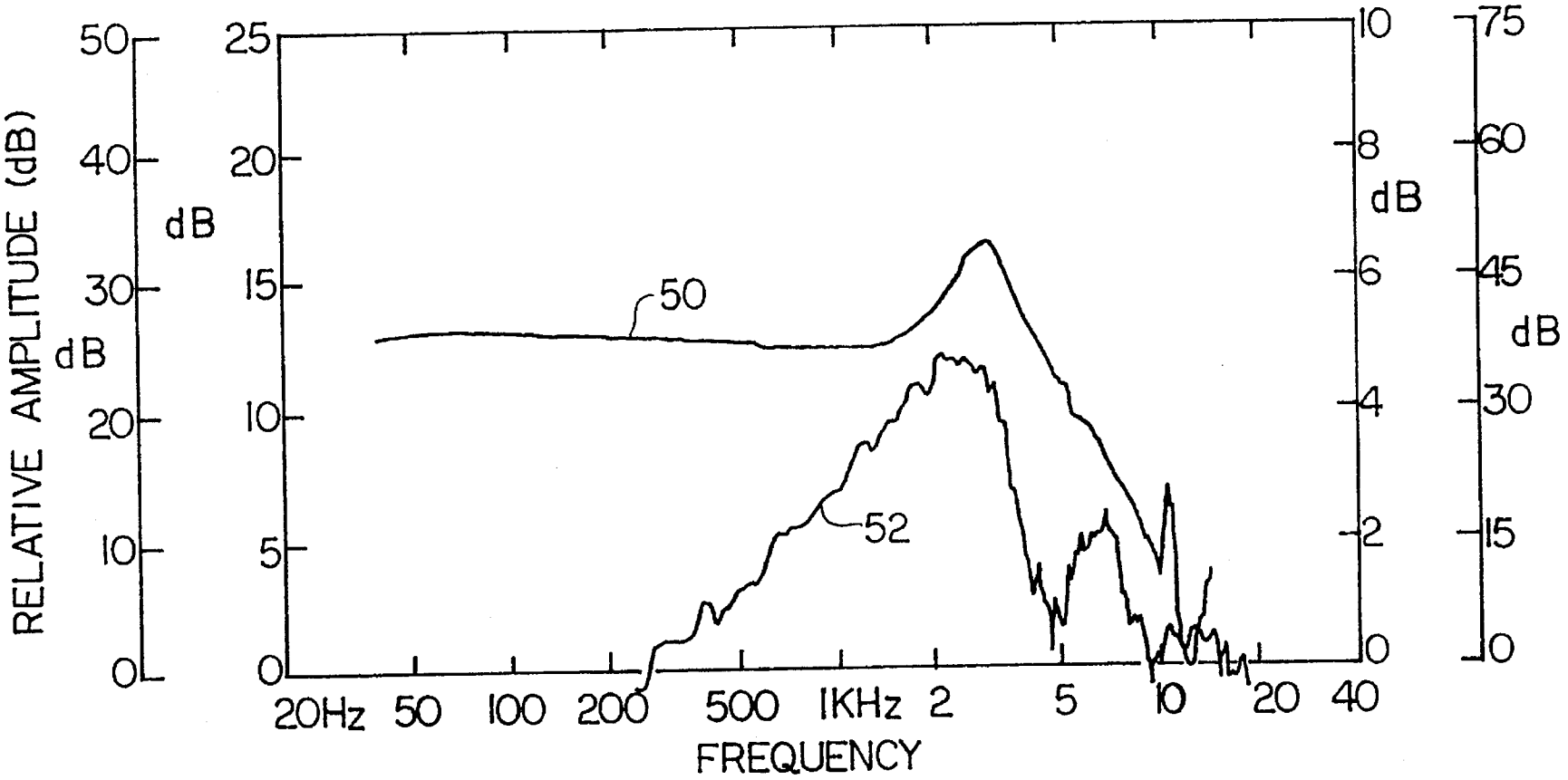
FIG. 4 is a plot of frequency response versus frequency of a microphone holder of the type shown in FIGS. 2 and 3.

Referring now to FIG. 4, viewing the front and rear cavities 25, 38 as equivalent to electrical capacitance in parallel and the aperture 29 as a series inductance, on resonance curve 50 can be drawn as shown in FIG. 4. The present design was created with a resonance peak at slightly over 3 KHz, the phone line upper limit, to produce a cut off of frequencies above that. Because the cavities and apertures are less effective at lower frequencies, the curve 50 is flat below the resonance curve.

The present design provides a strong rejection to sound at right angles as shown in response curve 52 due to the admission of cancelling sound through cavity 38 in the rear.

Having described preferred embodiments of the invention it will now become apparent to one of skill in the art that other embodiments incorporating their concepts may be used. It is felt therefore that these embodiments should not be limited to disclosed embodiments but rather should be limited only by the spirit and scope of the appended claims.

What is claimed is:

1. A microphone assembly comprising:

a housing comprising:

a basewall portion having a first surface and a second opposing surface and having a first aperture therethrough; and sidewall portions projecting from the first surface of said basewall portion to form a cavity region having a first substantially closed end provided by said basewall portion and a second substantially open end opposite the closed end;

a non-conductive cover, having a first surface having a second aperture therein, said cover disposed over the open end of the cavity region of said housing;

a plurality of interspaced support members each having a first end coupled to said cover and a second end;

a dielectric baffle coupled to the second ends of said support members such that a path is formed between said support members, and further such that said baffle is spaced a predetermined distance over the first surface of said cover in the region of the second aperture such that said baffle provides a barrier to electrostatic discharge; and a microphone disposed within said first aperture such that a distance dimension is defined between said microphone and said second aperture.

2. The microphone assembly of claim 1 wherein:

said basewall portion includes a first recess region in which the first aperture is provided, wherein the first recess region has a diameter less than the diameter of the cavity region of said housing;

the second aperture is located substantially in the center of said cover; and said baffle is provided from a dielectric material.

3. The microphone assembly of claim 2 wherein said predetermined distance between said first surface of said cover and said baffle is greater than 0.045 inches.

4. The microphone holder of claim 2 wherein the dimensions of the recess region of said basewall portion are selected to provided said housing with a predetermined acoustic response.

5. The microphone holder of claim 1 wherein said baffle is provided having a flat surface and at least one support member of said support members is connected to the flat surface of said baffle.

6. The microphone holder of claim 5 wherein said baffle is provided having a disc shape and a predetermined diameter and wherein the predetermined distance by which said baffle is spaced from over the first surface of said cover and the diameter of said baffle are selected to preserve an acoustic impedance characteristic provided by the cavity region and the first recess region of said housing.

7. A microphone assembly comprising:

a boom;

a housing disposed on a first end of said boom, said housing comprising:

a basewall portion having a first aperture therethrough; and sidewall portions disposed on a first surface of said basewall portion to form a cavity region wherein said basewall portion forms a first wall of the cavity region and a second end opposite the first wall is open;

a microphone disposed in said cavity region;

a cover, having a second aperture therein, disposed over the open second end of the cavity region;

a baffle having a first surface spaced a predetermined distance over a first surface of said cover in the aperture region of said cover, said baffle disposed to provide a barrier to electrostatic discharges;

a foam pad disposed on a first surface of said microphone; and a microphone boot disposed around said microphone.

8. The microphone assembly of claim 7 wherein said baffle comprises:

a dielectric member; and at least one support member having a first end and a second end with the first end of said at least one support member coupled to a first surface of said dielectric member and a second end of said at least one support member coupled to the first surface of said cover.

9. The microphone assembly of claim 8 wherein the aperture in said cover is located in the center of said cover.

10. The microphone assembly of claim 9 wherein said predetermined distance between said first surface of said cover and said baffle is greater than 0.045 inches.

11. A microphone assembly comprising:

a housing comprising:

a base portion having a first aperture therein; and sidewall portions disposed on said base portion to form a cavity region;

a microphone disposed in the cavity region of said housing;

a cover, having a second aperture therein, disposed over the cavity region of said housing;

a baffle disposed a predetermined distance over a first surface of said cover in the region of the second aperture;

wherein said base portion includes a first recess region having the first aperture therein; and wherein said baffle includes:

a dielectric member;

at least one support member coupled to a first surface of said dielectric member and a first surface of said cover; and a boom wherein the housing is disposed at the first end of the boom.

12. The microphone assembly of claim 11 wherein said dielectric member is provided having a disc shaped with a diameter not greater than the diameter of said cover.

13. The microphone assembly of claim 12 wherein said predetermined distance between said first surface of said cover and said dielectric member is greater than 0.045 inches.

14. The microphone holder of claim 13 further comprising:

a foam pad disposed on a first surface of said microphone; and a microphone boot disposed in the cavity region of said cover and shaped to accept said microphone.

15. The microphone holder of claim 14 further comprising a foam cover disposed around said housing and said baffle.

16. The microphone holder of claim 11 wherein the cavity is provided having a predetermined diameter and the first recess region of said base portion is provided having a diameter less than the diameter of the cavity.

17. The microphone holder of claim 11 wherein said sidewall portions project from a first surface of said base portion such that the cavity region is formed having a first substantially closed end provided by said base portion and a second substantially open end opposite the closed end.

18. The microphone holder of claim 17 wherein:

the open end of the cavity is provided having a substantially circular shape and a first diameter; and said cover is provided having a shape corresponding to at least a portion of the shape of the open end of the cavity.

19. The microphone holder of claim 18 wherein said cover is provided having a diameter selected such that when said cover is disposed over the open end of the cavity, said cover engages in a snap fit with the sidewall portions of said housing.

* * * * *